US011867020B2

(12) United States Patent
Carragher

(10) Patent No.: US 11,867,020 B2
(45) Date of Patent: Jan. 9, 2024

(54) EXPANDABLE EUTECTIC ALLOY BASED DOWNHOLE TOOL AND METHODS OF DEPLOYING SUCH

(71) Applicant: BiSN Tec Ltd, Lymm (GB)

(72) Inventor: Paul Carragher, Birchwood Warrington Cheshire (GB)

(73) Assignee: BiSN Tec. Ltd., Cheshire (GB)

( * ) Notice: Subject to any disclaimer, the term of this patent is extended or adjusted under 35 U.S.C. 154(b) by 353 days.

(21) Appl. No.: 16/764,629

(22) PCT Filed: Nov. 16, 2018

(86) PCT No.: PCT/GB2018/053333
§ 371 (c)(1),
(2) Date: May 15, 2020

(87) PCT Pub. No.: WO2019/097252
PCT Pub. Date: May 23, 2019

(65) Prior Publication Data

US 2020/0332620 A1 Oct. 22, 2020

(30) Foreign Application Priority Data

Nov. 17, 2017 (GB) ..... 1719093

(51) Int. Cl.
*E21B 33/12* (2006.01)
*E21B 43/10* (2006.01)
(Continued)

(52) U.S. Cl.
CPC ..... *E21B 33/1212* (2013.01); *E21B 29/10* (2013.01); *E21B 33/1208* (2013.01);
(Continued)

(58) Field of Classification Search
CPC ..... E21B 43/103; E21B 43/105; E21B 43/106
See application file for complete search history.

(56) References Cited

U.S. PATENT DOCUMENTS 1,534,229 A 4/1925 Livergood
2,076,308 A 4/1937 Wells
(Continued)

FOREIGN PATENT DOCUMENTS

CA 2592556 6/2007
EP 1 933 004 6/2008
(Continued)

OTHER PUBLICATIONS

Oct. 16, 2018, PCT, PCT/GB2018/051428 Search and Opinion.

*Primary Examiner* — Robert E Fuller

(57) ABSTRACT

The method comprising providing a eutectic alloy based downhole tool comprising a tubular body with eutectic alloy located on an outer surface thereof, said tool having an outer diameter with a clearance from the inner diameter of the well. The downhole tool is delivered to a target region within an oil/gas well where the tool is to be deployed. Once the tool is in position within the well a tubular expanding tool is run through the interior of the tubular body so as to increase the outer diameter of the sealing downhole tool and in so doing reduce the clearance between the alloy and the well. A heater is deployed within the tubular body proximal to the alloy and operated to melt the alloy. The alloy is then allowed to cool and resolidify, whereby the tool is sealed in place within the target region of the well using the alloy.

20 Claims, 11 Drawing Sheets

(51) Int. Cl.

| | |
|---|---|
| ***E21B 29/10*** | (2006.01) |
| ***E21B 33/13*** | (2006.01) |
| ***E21B 33/138*** | (2006.01) |
| ***E21B 36/00*** | (2006.01) |
| ***E21B 43/08*** | (2006.01) |

(52) U.S. Cl.

CPC ..... *E21B 33/13* (2013.01); *E21B 33/138* (2013.01); *E21B 36/00* (2013.01); *E21B 36/003* (2013.01); *E21B 43/08* (2013.01); *E21B 43/103* (2013.01)

(56) References Cited

U.S. PATENT DOCUMENTS

| | | | | |
|---|---|---|---|---|
| 2,686,689 | A | 8/1954 | Douglas | |
| 2,789,004 | A | 4/1957 | Forster | |
| 2,822,876 | A | 2/1958 | Murrow | |
| 3,119,451 | A | 1/1964 | Hall | |
| 3,170,516 | A | 2/1965 | Corley | |
| 3,208,530 | A | 9/1965 | Allen | |
| 3,871,315 | A | 3/1975 | Anderson | |
| 4,134,452 | A | 1/1979 | Kingelin | |
| 4,423,783 | A | 1/1984 | Haag | |
| 4,488,747 | A | 12/1984 | Austin | |
| 4,523,640 | A | 6/1985 | Wilson | |
| 4,696,343 | A | 9/1987 | Anderson | |
| 5,052,489 | A | 10/1991 | Carisella | |
| 5,564,861 | A | 10/1996 | Khudenko | |
| 6,102,120 | A | 8/2000 | Chen | |
| 6,454,001 | B1 | 9/2002 | Thompson | |
| 6,474,414 | B1 | 11/2002 | Gonzalez | |
| 6,664,522 | B2 | 12/2003 | Spencer | |
| 6,828,531 | B2 | 12/2004 | Spencer | |
| 6,923,263 | B2 | 8/2005 | Eden | |
| 7,152,657 | B2 | 12/2006 | Bosma | |
| 7,290,609 | B2 | 11/2007 | Wardlaw | |
| 2002/0162596 | A1 | 4/2002 | Simpson | |
| 2002/0056553 | A1 | 5/2002 | Duhon | |
| 2003/0132224 | A1 | 7/2003 | Spencer | |
| 2004/0149418 | A1* | 8/2004 | Bosma | E21B 29/10 164/98 |
| 2004/0261994 | A1 | 12/2004 | Nguyen | |
| 2005/0109511 | A1 | 5/2005 | Spencer | |
| 2006/0144591 | A1 | 7/2006 | Gonzalez | |
| 2007/0051514 | A1 | 3/2007 | La Rovere | |
| 2010/0006289 | A1 | 1/2010 | Spencer | |
| 2010/0263876 | A1 | 10/2010 | Frazier | |
| 2011/0132223 | A1 | 6/2011 | Streibich | |
| 2011/0146519 | A1 | 6/2011 | Han | |
| 2011/0174484 | A1 | 7/2011 | Wright | |
| 2011/0214855 | A1 | 9/2011 | Hart | |
| 2012/0199351 | A1 | 8/2012 | Roberston | |
| 2012/0205872 | A1* | 8/2012 | Reinhardt | E21B 43/103 277/336 |
| 2012/0298359 | A1 | 11/2012 | Eden | |
| 2013/0087335 | A1 | 4/2013 | Carraher | |
| 2013/0192833 | A1 | 8/2013 | Gano | |
| 2014/0318782 | A1 | 10/2014 | Bourque | |
| 2015/0047841 | A1 | 2/2015 | Mazyar | |
| 2015/0211326 | A1 | 7/2015 | Lowry | |
| 2015/0211327 | A1 | 7/2015 | Lowry | |
| 2015/0211328 | A1 | 7/2015 | Lowry | |
| 2015/0345248 | A1 | 12/2015 | Carragher | |
| 2015/0368542 | A1 | 12/2015 | Carragher | |
| 2016/0145962 | A1 | 5/2016 | Carragher | |
| 2016/0319633 | A1 | 11/2016 | Cooper | |
| 2017/0030162 | A1 | 2/2017 | Carragher | |
| 2017/0089168 | A1 | 3/2017 | Carragher | |
| 2017/0226819 | A1 | 8/2017 | Carragher | |
| 2017/0234093 | A1 | 8/2017 | Carragher | |
| 2017/0234100 | A1 | 8/2017 | Carragher | |
| 2017/0306717 | A1 | 10/2017 | Carragher | |
| 2019/0085659 | A1 | 3/2019 | Carragher | |
| 2019/0014355 | A1 | 5/2019 | Carragher | |
| 2019/0186230 | A1 | 6/2019 | Carragher | |

FOREIGN PATENT DOCUMENTS

| | | |
|---|---|---|
| GB | 2016063 | 9/1979 |
| GB | 2 164 886 | 4/1986 |
| WO | WO 2002/099247 | 12/2002 |
| WO | WO 2011/151171 | 12/2011 |
| WO | WO 2013/066340 | 5/2013 |
| WO | WO 2016/049424 | 3/2016 |

* cited by examiner

EXPANDABLE EUTECTIC ALLOY BASED DOWNHOLE TOOL AND METHODS OF DEPLOYING SUCH

This application is: (i) a national stage entry under 35 U.S.C. § 371 of PCT/GB2018/053333 filed Nov. 16, 2018, which claims priority to application serial no. GB 1719093.5 filed Nov. 17, 2017; and, the entire disclosures of each of which are incorporated herein by reference.

FIELD OF THE INVENTION

The present invention relates to tools for use in downhole environments such as oil and gas wells. In particular, the present invention relates to expandable tools capable of being deployed downhole and secured in position using eutectic alloys, such as bismuth containing alloys.

BACKGROUND OF THE INVENTION

In order to access oil and gas deposits located in underground formations it is necessary to drill bore holes into these underground formations and deploy production tubing to facilitate the extraction of the oil and gas deposits.

During the creation, operation and abandonment of oil and gas wells there is often the need to deploy a plug within the well or seal of a portion of the well. This can involve securing a tool in position within a downhole target region.

One common downhole task is repairing existing well tubing, which due to the downhole environment can develop fractures/leaks over time. Another common task is to isolate (whether temporarily or semi-permanently) a region of a well from the rest of the production tubing.

Various downhole tools are currently employed in such tasks. Some of the most commonly used downhole tools include: bridge plugs, patches, scab and straddles. In order to secure the downhole tool within a well such tools are typically provided with hydraulically actuated means that can be operated to engage with the surface of a surrounding tubing (e.g. a well casing, well liner or production tubing).

A plurality of these engagement means, which are commonly referred to as 'dogs' or 'slips', are normally provided on a downhole tool so that once the tool is in place they can be actuated to lock the tool in position relative to the surrounding tubing.

Once the required task has been completed by the downhole tool, the 'dogs' or 'slips' can be retracted and the tool can be retrieved from the well.

Although the 'dogs' or 'slips' are capable of retaining a downhole tool in position within a well, they do not form a gas tight seal with the surrounding tubing. In view of this, on occasions where a gas tight seal is required the downhole tool is provided with additional sealing means, such as rubber seals. This can increase the possibility of a malfunction of the downhole tool.

An alternative approach, which has been developed by the applicant, utilises the interesting properties of eutectic alloys, such as bismuth containing alloys, to help securely locate tools within downhole target regions.

In particular, published International PCT Application No. WO2016/024123 discloses a variety of different options for using eutectic/bismuth based alloys mounted on the exterior walls of a tubular tool to secure the tool within a downhole target region.

In operation, a heat source is inserted into the tubular tool and positioned at a point within the tool that is adjacent to the externally mounted alloy. Once in position the heat source is used to melt the alloy, which flows a short distance before it begins to cool and turn back into a solid.

Through this process the alloy can form a connection between the tubular tool and the nearby surrounding structure, which will typically be a well casing or tubing but could also be the surrounding formation from which the well has been formed.

In cases where the surrounding structure is a well casing/tubing, the alloy forms a metal to metal connection between the tubular tool and the surrounding well casing/tubing. Once the tubular tool has been secured in place, the heater is retrieved leaving the interior of the secured tool clear. In situations where a plug is required, the lower end of the tubular tool can be capped or blocked off.

One common problem faced during the above described downhole operations is operation of actually delivering the downhole tool to the target location within the well so that it can be secured in place. This is because the passage of the tool into the well can be impaired by obstacles in the well and/or bends in the well (e.g. deviated wells).

In order to provide downhole tools with improved manoeuvrability the applicant has developed various ways of reducing the outer diameter of the downhole tool. This helps to maximise the clearance between the downhole tool and the well bore or well casing/tubing, without sacrificing the tool's ability to form a metal to metal connection between the tool and the surrounding casing/tubing.

European Patent No 2935764, which is one of the applicant's earlier cases, provides a eutectic alloy based plugging tool that is provided with a compressible plug portion. The compressible plug portion is resiliently biased towards a larger outer diameter that the rest of the plug. The compressible plug portion can thereby reduce its outer diameter when it reaches an obstruction within a well and then spring back to its original larger diameter once it is past the obstruction. The compressible plug portion serves to reduce the clearance between the tool and the surrounding casing/tubing, such that it serves as a platform that helps direct the melted alloy towards the surrounding casing/tubing.

SUMMARY OF THE INVENTION

With a view to addressing the issues faced by deploying tools within wells with possible restrictions, the present invention provides an expandable eutectic alloy based downhole tool and methods for deploying such within various downhole target regions in oil/gas wells.

The present invention provides a method of deploying a eutectic alloy based tool within an oil/gas well, said method comprising: providing a eutectic alloy based downhole tool comprising a tubular body with eutectic alloy located on an outer surface thereof, said tool having an outer diameter with a clearance from the inner diameter of the well; delivering the downhole tool to a target region within an oil/gas well where the tool is to be deployed; running a tubular expanding tool through the interior of the tubular body so as to increase the outer diameter of the downhole tool and in so doing reduce the clearance between the eutectic alloy and the well; positioning a heater within the tubular body proximal to the eutectic alloy and operating the heater to melt the eutectic alloy; allowing the eutectic alloy to cool and resolidfy so as to seal the tool in place within the target region of the well using the alloy.

Preferably the eutectic alloy may be located on the outer surface of the tubular body at the end regions of the tubular body. In this way the alloy can be used to seal both ends of the tubular body to the surrounding well casing/tubing. A straddle tool could be deployed within an oil/gas well using this approach.

Preferably at least the eutectic alloy may be covered with an outer sleeve. The outer sleeve provides mechanical protection to the eutectic alloy when the tool is deployed.

Further preferably the outer sleeve may have insulating properties. Although not essential, providing an outer sleeve with insulating properties is considered highly beneficial because it serves to reduce heat loss from the tool of the present invention. This means that any heat generated by the tool is used more efficiently, which in turn means that less chemical heat source material, for example, is needed to achieve a certain heat output. This again allows the weight of the assembly to be reduced.

Providing an outer sleeve with insulating properties also helps to prevent heat being 'sucked away' from the tool as a consequence of the environmental condition within the target region. By way of an example, it is envisioned that insulating the tool in this way prevents heat loss as a result of 'cross-flow' within the well.

'Cross-flow' occurs when fluids move down a pressure gradient within the well and in doing so create a flow of fluids past the target region which could remove heat from the region over time.

Providing the insulation also helps to 'super heat' the alloy that is held between the heater body and the sleeve. This enables the molten alloy to penetrate further into the surrounding environment when it eventually leaves the tool. This is considered particularly beneficial when forming seals in wells located in sand pack formations, (e.g. OHGPs).

Preferably the outer sleeve may comprise one or more openings in the region adjacent to the collar. Alternatively the outer sleeve may comprise one or more weakened points in the region adjacent to the collar; said weakened points being configured to fail before the rest of the insulating sleeve, thereby revealing openings.

It is appreciated that by providing openings in the sleeve, or alternatively weakened regions that will become openings in the sleeve during the operation of the heater, it is possible focus the locations where molten alloy escapes. Locating the openings/weakened regions adjacent the collar of the heater ensures that the alloy is ejected in a focused manner within the target region of the well.

Preferably the expanding tool may be operated to increase the outer diameter of the entire downhole tool. Alternatively, however, the expanding tool may be operated selectively so as to only increase the outer diameter of the downhole tool in the parts of the tubular body where the alloy is located.

It is envisaged that expanding only the part of the tubular body on which the eutectic alloy is located achieves the desired technical result of reducing the clearance between the alloy and the surrounding well casing/tubing more quickly because the expanding tool does not have to be run through the entire length of the tubular body.

It is envisaged that the expanding tool may be run through the tubular body in either a down hole direction or an up hole direction, that is away from the surface or towards the surface respectively.

Preferably the eutectic alloy may be located along the entire length of the tubular body. Whilst not essential, it is envisaged that providing alloy along the entire length may be desirable in certain situations, such as when an increased amount of alloy is required to repair multiple defects in a target region. Also, the alloy may be provided along the entire length of the tubular body if the tool is relatively short in length, this ensures that sufficient alloy is provided to form a complete seal.

Preferably the method comprises deploying the tool within an Open Hole Gravel Pack and wherein the method involves directing the melted alloy through a sandscreen present in the Open Hole Gravel Pack.

It is envisaged that the method of the present invention is particularly suited to deploying tools, such as straddles, within Open Hole Gravel Packs (OHGPs). This is because expanding the tool to urge the eutectic alloy closer to the well (i.e. the sandscreen) ensures that melted alloy can penetrate further through the holes in the sandscreen into the surrounding annulus. This helps provide a more complete seal within an OHGP.

The present invention also provides an expandable eutectic alloy based downhole tool that is suitable for use in the method of the present invention. In this regard, the present invention provides two alternative configurations of downhole tool.

In a first embodiment, the present invention provides an expandable eutectic alloy based downhole tool, said tool comprising: a tubular body configured to be expanded when an expanding tool is run through the inside thereof; one or more eutectic alloy elements provided on the outside of the tubular body, wherein each eutectic alloy element only extends partially around the circumference of the outside of the tubular body.

It will be appreciated that a gap can be created by not completely encircling the tubular body with a single eutectic alloy element. Each gap in the alloy accommodates the expansion of the tubular body without necessarily fracturing the alloy, which is commonly more brittle than the steel from which the tubular bodies are typically formed.

Preferably the tool may comprise an interrupted alloy ring that encircles the tubular body, the ring being formed from one of more of said alloy elements arranged in series around the circumference of the tubular body.

It is appreciated that placing a plurality of alloy elements around the outside of the tubular body further helps to accommodate the expansion of the tubular body and avoid the alloy being damaged during the expansion process.

Further preferably said alloy elements may form a plurality of interrupted rings on the outside of the tubular body. In addition, the plurality of interrupted rings may be offset from one another so that the interruptions in one alloy ring are not aligned with the interruptions in an adjacent ring.

In this way it is ensured that alloy is provided around the entire circumference of the tubular body, which thereby avoids the possibility of gaps being created in the final seal formed when the alloy is melted and subsequently allowed to cool and resolidify.

Preferably, in the case of multiple rings, two or more interrupted alloy rings may be connected together. It is envisaged that such an arrangement would facilitate the more secure mounting of the alloy on the outside of the tubular body.

Alternatively a single alloy ring may be formed that extends along at least half of the length of the tubular body.

Additionally or alternatively said alloy elements may be mounted on an expandable collar that is then secured to the tubular body. In this way, even though the alloy does not completely encircle the tubular body, the collar can completely encircle the tubular body, which would help further secure the alloy in position on the outside of the tubular body.

Preferably the alloy elements may be provided along the entire length of the tubular body. Although the preferred embodiments of the present invention described hereinafter only provide the alloy at certain points along the length of the tubular body, it is envisaged that the alloy could be provided along the entire length thereof.

In this regard the alloy rings may extend the entire length of the tubular body.

Alternatively, the alloy elements may be in the form of a plurality of strips that run the length of the outside of the tubular body.

Preferably the tool may further comprise an outer sleeve that covers at least the region of the tool where the alloy elements are located. As detailed above, the sleeve provides mechanical protection to the alloy provided on the outside of the tubular body.

Further preferably the outer sleeve may have insulating properties.

In addition, or alternatively, the outer sleeve may have openings, or weakened regions that form openings when in contact with melted alloy, that provide a focused outlet for the alloy when it is melted. The benefits of these various features of the outer sleeve are detailed above.

In the second tool configuration the present invention provides an expandable eutectic alloy based downhole tool, said tool comprising: a tubular body configured to be expanded when an expanding tool is run through the inside thereof; an outer sleeve, wherein the tubular body and the outer sleeve together define a housing with a volume within which eutectic alloy can be retained; and wherein the eutectic alloy retained with the housing does not fill the volume of the housing defined by the tubular body and the outer sleeve.

In contrast to the first tool configuration, it is not considered essential that the eutectic alloy does not completely encircle the expandable tubular body.

This is because it does not matter if the alloy breaks during the expansion of the tubular body. In this regard the housing defined by the tubular housing and the outer sleeve ensures that the alloy, even when damaged, is held in position relative to the tubular body ready for the introduction of a heat source.

The creation of a housing to retain the alloy therefore makes it less important to protect the alloy from fracture when the tubular body, upon which the alloy is provided, expands.

Preferably the alloy may be provided as at least one annular shaped block that encircles the tubular body and there is clearance between the outer surface of said alloy block and the outer sleeve to accommodate the expansion of the tubular body and the alloy.

Further preferably said sleeve has openings, or weakened regions that form openings when in contact with melted alloy, that provide a focused outlet for the alloy when it is melted.

Alternatively the alloy may be provided as shot or pellets and such shot or pellets do not completely fill the housing when the tubular body is in an un-expanded state. In such arrangements the sleeve may have weakened regions that form openings when in contact with melted alloy, wherein said openings provide a focused outlet for the alloy when it is melted.

Although not essential to the second tool configuration, preferably the outer sleeve has insulating properties. The technical benefits of the above features will be appreciated from the earlier description of these features above.

Although the tools of the first and second configurations differ on certain points they are both directed to the same aim, namely to retain the alloy in place so that the deployed heater can melt the alloy when the time comes.

BRIEF DESCRIPTION OF THE DRAWINGS

The various aspects of the present invention will now be described with reference to preferred embodiments shown in the drawings, wherein.

DETAILED DESCRIPTION OF THE PREFERRED EMBODIMENTS OF THE PRESENT INVENTION

The expandable alloy-based downhole tool of the present invention disclosed herein is considered particularly suitable for use in downhole operations that take place within gas and oil wells. In particular, the well tool deployed in accordance with the present invention is considered particularly suitable for use in repair operations involving Open Hole Gravel Packs.

The term 'Open Hole Gravel Pack' (OHGP) is used throughout to indicate when a screen is used to hold back proppant/sand in a completion. It will be appreciated that, in practise, this covers all gravel pack completions including open hole, cased hole and frac packs.

Although the sealing and repair of Open Hole Gravel Pack is considered a particular suitable application of the present invention, it is envisioned that the downhole tool deployment assembly of the present invention can also be employed in other well repair operations, as well as in well abandonment.

Given the main focus of the present invention, the preferred embodiments will be described with oil and gas wells in mind. However, it is envisioned that the apparatus and methods described could be usefully applied in other technical fields, such as those fields where underground conduits are to be plugged (e.g. water pipes).

Figure 1:
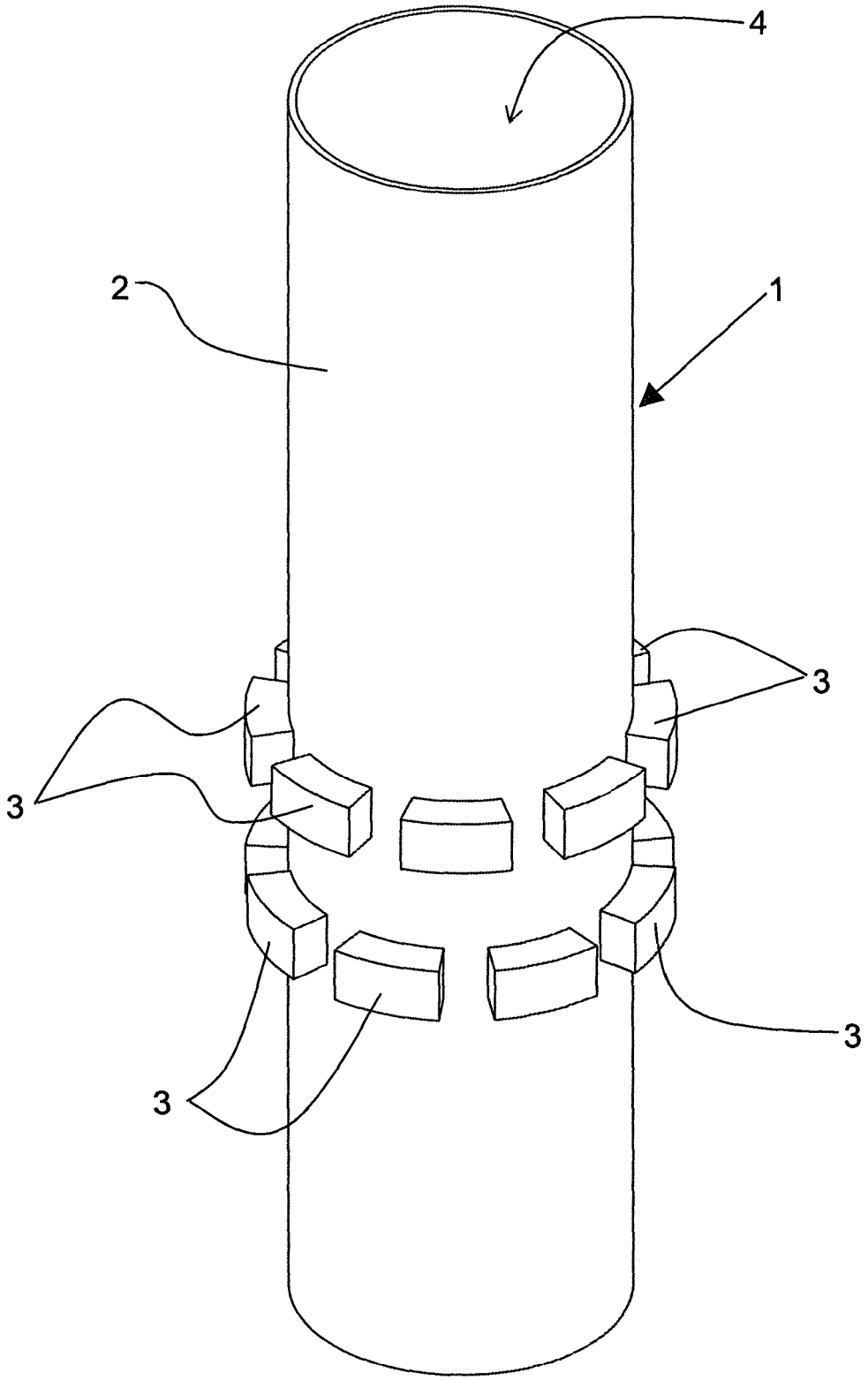
FIG. 1 shows a first embodiment of a first configuration of the pre-expanded expandable eutectic alloy based downhole tool in accordance with the present invention.

FIG. 1 shows a preferred embodiment of the first configuration of the downhole tool of the present invention. The tool 1 comprises a tubular body 2 with a plurality of eutectic alloy elements 3 located on its outer surface. It is envisioned that the elements can be secured in place directly on the tubular body using a suitable adhesive and/or using mechanical fixings such as rivets, bolts and screws.

Alternatively, the eutectic alloy elements 3 may be mounted on a collar using the above means and then the collar is secured in place around the circumference of the tubular body.

The tubular body, unlike the eutectic alloy, is formed from a material that is capable of being stretched so as to increase its outer diameter such as steel. It is appreciated that steel pipes having a wall thickness of ¼ to ½ inches can achieve an expansion of about 1 inch.

As explained in more detail below, the tubular body 2 is stretched by drawing a conventional expanding tool through its interior 4. It is envisages that the expanding tool can be drawn through the tubular body in either an up hole direction or a down hole direction (i.e. towards the surface or away from the surface).

The eutectic alloy elements 3 are positioned in series around the outer circumference of the tubular body so as to form interrupted eutectic alloy rings that encircle the tubular body 2. Each interrupted ring is provided with a plurality of gaps that help the alloy ring to accommodate the expansion of the tubular body 2 without fracturing.

Although the interrupted ring is shown in FIG. 1 as having a plurality of gaps, it is envisaged that a single eutectic alloy element, which substantially encircles the tubular body as has a single gap, may also be employed without departing from the general concept of the present invention.

As can be seen from FIG. 1, the gaps between the alloy elements 3 in a first interrupted ring are offset from the gaps between the alloy elements 3 in a neighbouring interrupted ring. It is envisioned that this offsetting of the gaps helps to prevent the formation of gaps in the alloy seal formed when the tool is heated by a heater received within the interior 4 of the tubular body 2.

Although the elements 3 shown in FIG. 1 form interrupted rings that are relatively narrow when compared to the length of the tubular body 2, it is envisaged that the elements 3 may extend further along the length of the tubular body. Indeed it is envisaged that the eutectic alloy elements may extend along the entire length of the tubular body 2, either in the form of a single interrupted ring or multiple interrupted rings of suitable lengths.

Figure 2A:
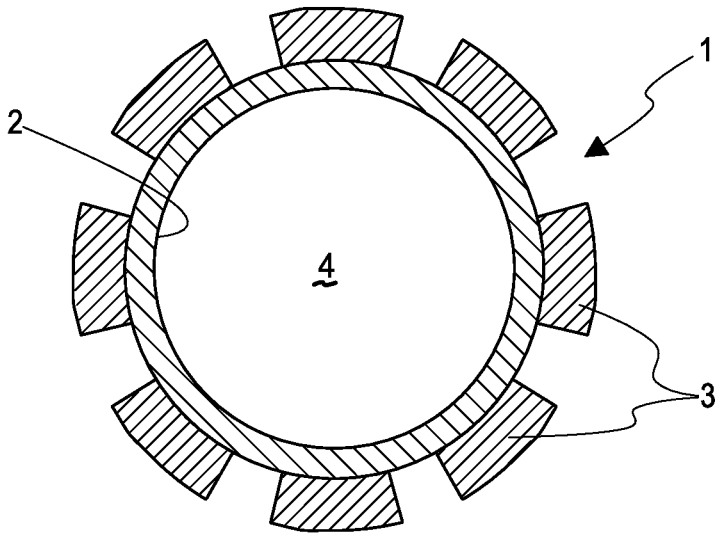
FIG. 2A shows a plan view of the pre-expanded downhole tool shown in FIG. 1.
Figure 2B:
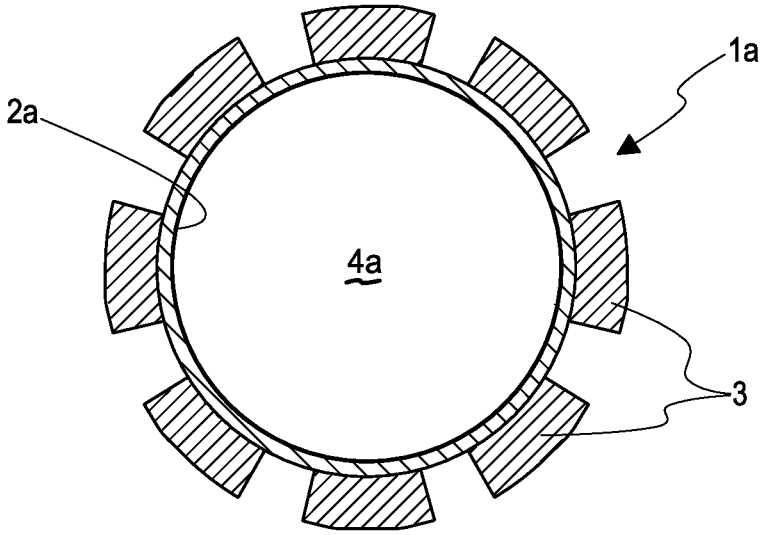
FIG. 2B shows a plan view of the downhole tool of FIGS. 1 and 2A in an expanded state.

The arrangement of the eutectic alloy elements, and their ability to accommodate the expansion of the tubular body on which they are provided, will be better appreciated from the plan views provided in FIGS. 2A and 2B.

FIG. 2A shows a plan view of tool 1 in an unexpanded state. However, in order to clearly show the gaps between the alloy elements 3 only one interrupted ring is shown in the figure.

As described above the tool comprises a tubular body 2 with a plurality of eutectic alloy elements 3 located around the outer circumference thereof. The elements 3 are arranged in a spaced manner around the circumference so that there are gap between adjacent elements 3.

The tubular body 2 is provided with an internal void 4 into which a heater can be received.

FIG. 2B shows a plan view of tool 1 in an expanded state as expanded tool 1*a*. As with FIG. 2A only one interrupted alloy ring is shown for the sake of clarity.

Upon comparison FIGS. 2A and 2B it will be clear that the gaps between the eutectic alloy elements 3 accommodate the expansion of the tubular body 2 to form the expanded tubular body 2*a*. In the expanded state the size of the gaps between adjacent alloy elements 3 is increased. The internal void 4*a* is also increased in diameter following the expansion of the tubular body 2*a*.

Although not shown in FIG. 1, 2A or 2B, it is envisaged that the tool may also be provided with an outer sleeve which covers at least the region of the tool where the eutectic alloy elements are located. The provision of a sleeve helps to protect the alloy elements from damage when the tool is delivered down a well. This is advantageous because eutectic alloys, such as bismuth based alloys, can be more susceptible to damage that the rest of the tool (i.e. the tubular body).

The downhole tool deployment method of the present invention will now be described with reference to FIG. 3, which shows the key stages of the deployment of a downhole tool of the type shown in FIG. 1.

In the first stage the tool 1 is delivered down a well 5. It will be appreciated that the walls of the well may be provided by a well casing or well tubing. As can be seen from FIG. 3 the difference between outer diameter of the tool and the inner diameter of the well ensures that there is a clearance between the tool and the well.

It is envisaged that the outer diameter of the tool should be such that there is clearance between the tool and the well at its most restricted (i.e. narrowest) point.

Once in position the tool can be temporarily secured in place within the well using conventional means, such as a hydraulically actuated elastomer seal or 'slips'. More details on this will be provided in the following description of the further embodiment of the method shown in FIGS. 5, 6 and 7.

Once secured in position an expanding tool 6 can be run through the interior of the tubular body 2 of the tool 1 so as to deform the tubular body outwards and, by so doing, expand the tubular body 2*a*. In the expanded state the eutectic alloy elements 3 located on the outer surface of the tubular body are brought closer to the well 5 so as to reduce the clearance between the tool 1 and the well 5.

Figure 3:
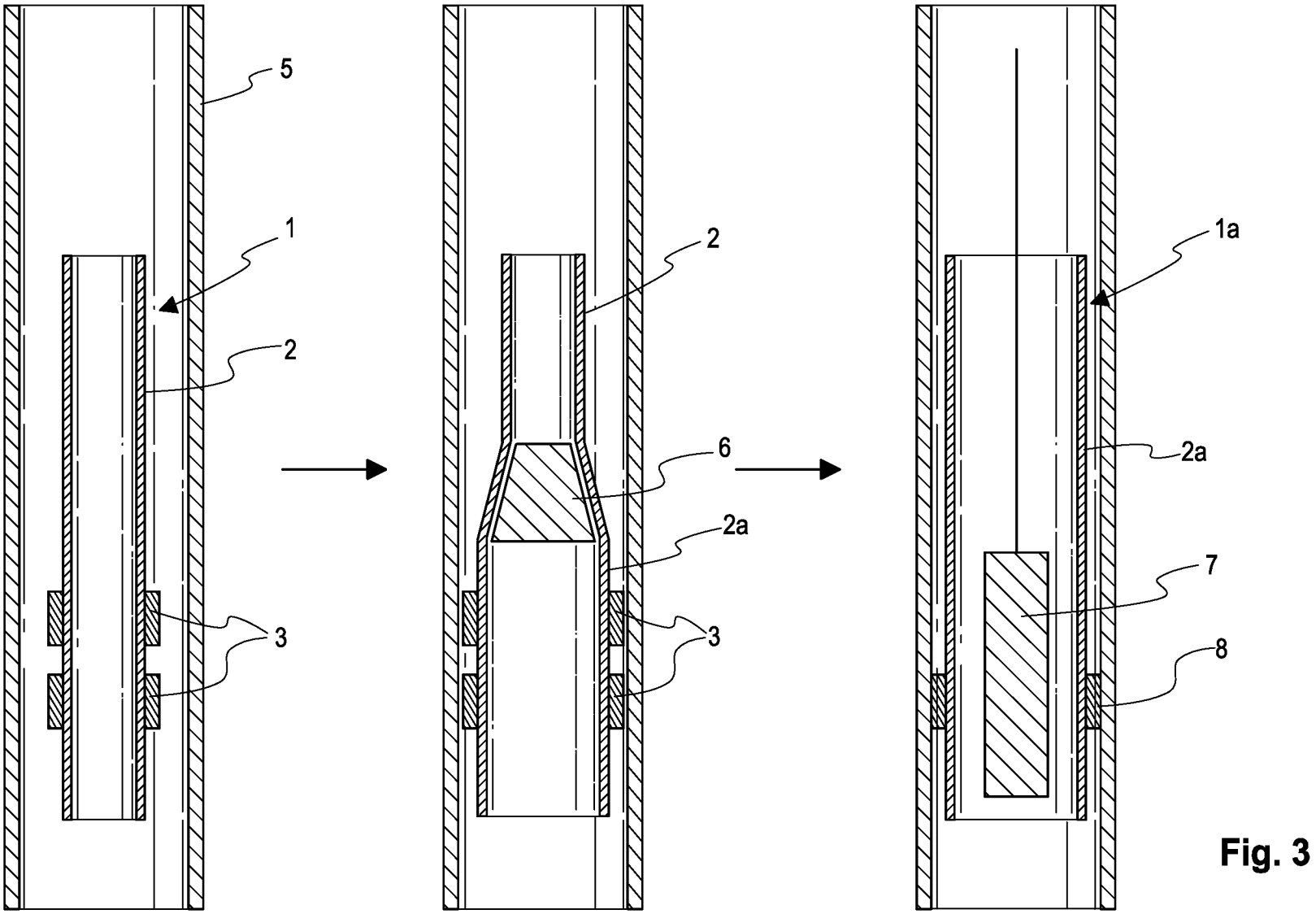
FIG. 3 is a diagrammatic representation of the key stages of deploying the first embodiment of the expandable eutectic alloy based downhole tool of the present invention shown in FIG. 1.

In the method represented in FIG. 3 the entire length of the tubular body 2 is expanded by the expanding tool 6. However, it is envisaged that only those portions of the tubular body 2 located adjacent to the eutectic alloy elements 3 need to be expanded. As such the method may involve using the expanding tool 6 on certain parts of the tubular body 2.

Turning now to the final stage of the method show in FIG. 3, it can be seen that once the tool has been expanded so as to bring the eutectic alloy elements 3 closer to the well casing/tubing 5 a heater is deployed down the well. The heater 7 is deployed downhole and located within the interior 4 of the expanded tubular body 2*a* of the expanded tool 1*a*.

The heater 7 is positioned within the interior of the tubular body 2*a* so as to be adjacent to the eutectic alloy elements 3 located on the exterior of the expanded tubular body 2*a*.

Once in position the heater, which is preferably a chemical based heater such as a thermite heater, is activated to heat and melt the eutectic alloy.

Upon melting the eutectic alloy that formed the elements 3 will flow away from the heat source and immediately start to cool and resolidify due, in part, to the cooling effect of the downhole fluids present in the target region of the well.

Although not shown in the figures, it is envisaged that the downhole tool may be provided with means for slowing the flow of the alloy down the well.

One example of a suitable means would be an elastomer seal mounted on the exterior of the tubular body 2 further downhole of the eutectic alloy elements 3. It is envisaged that the elastomer seals could be arranged to extend at least as far as the alloy elements 3 and possibly even beyond so that when the tubular body is expanded the seals are also moved closer to the well casing/tubing 5. The expanded seals serve to slow the flow of the alloy so that it has longer to cool and solidify.

Alternatively or in addition to the elastomer seal it is envisaged that the anchoring ring described hereinafter can also reduce the loss of melted alloy down hole.

Furthermore, a skirt portion made from a thermally conductive material, such as aluminium, could be provided below the region of the alloy. This skirt region allows downhole fluids to flow inside it and in so doing speeds up the rate at which heat can be extracted from the melted alloy, which in turn speeds up the rate of cooling of the alloy so that it solidifies sooner.

As the eutectic alloy sets it forms a seal 8 between the outside of the expanded tubular body 2*a* and the inside of the well 5. The alloy seal 8 serves to secure the tubular body 2*a* in place within the well 5 with a gas tight seal.

Once the seal has been formed and the tool 1 a has been secured in position the temporary securing means (e.g. hydraulic seal, slips, etc.) can be disengaged and retrieved via the expanded interior of the tubular body 2*a*. In an alternative arrangement the temporary securing means can be disengaged and retrieved before the heating stage, that is once the expanding tool has been operated to expand the tubular body 2.

Figure 4A:
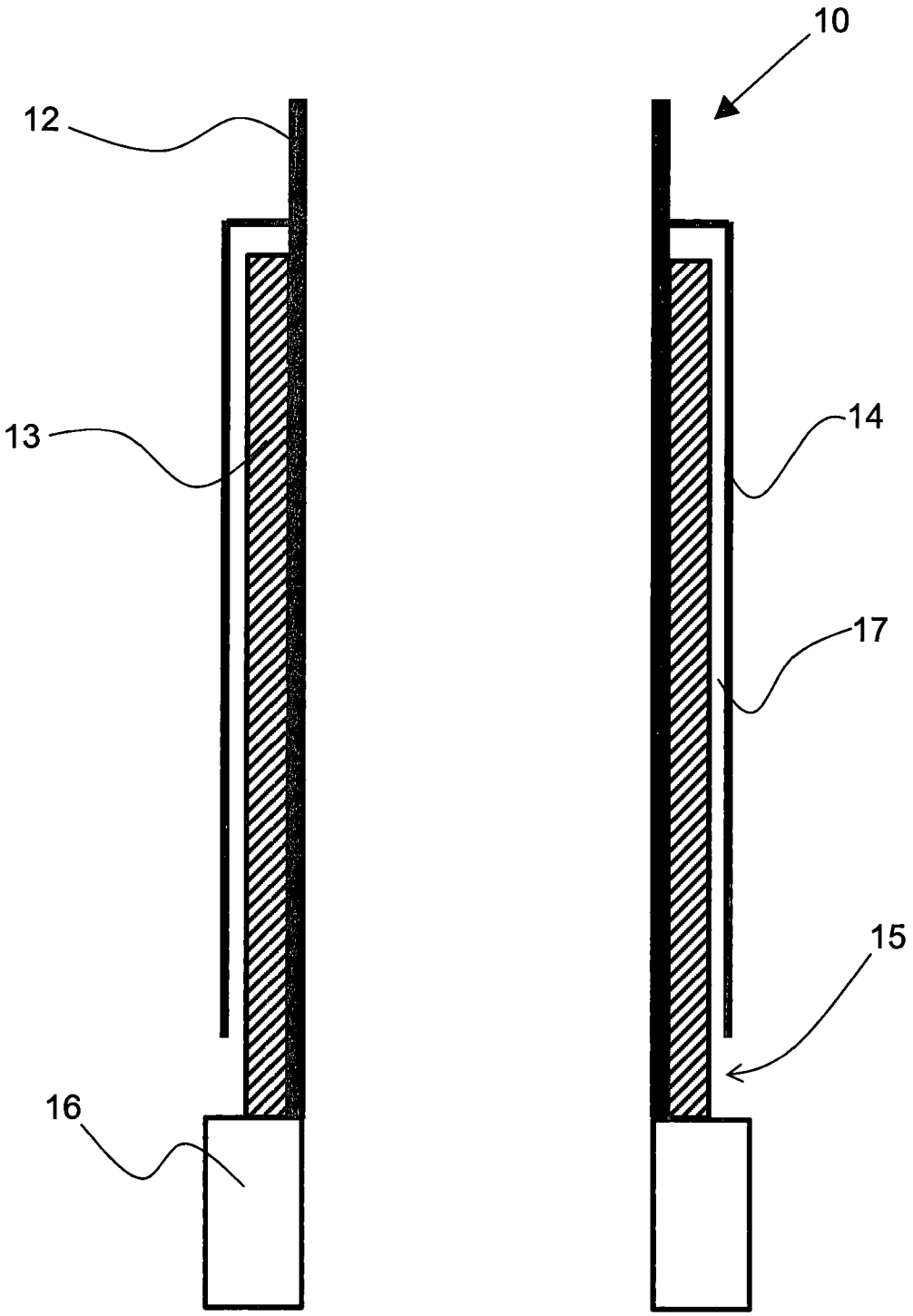
FIG. 4A shows a cross-sectional view of a first embodiment of a second configuration of the pre-expanded expandable eutectic alloy based downhole tool in accordance with the present invention.
Figure 4B:
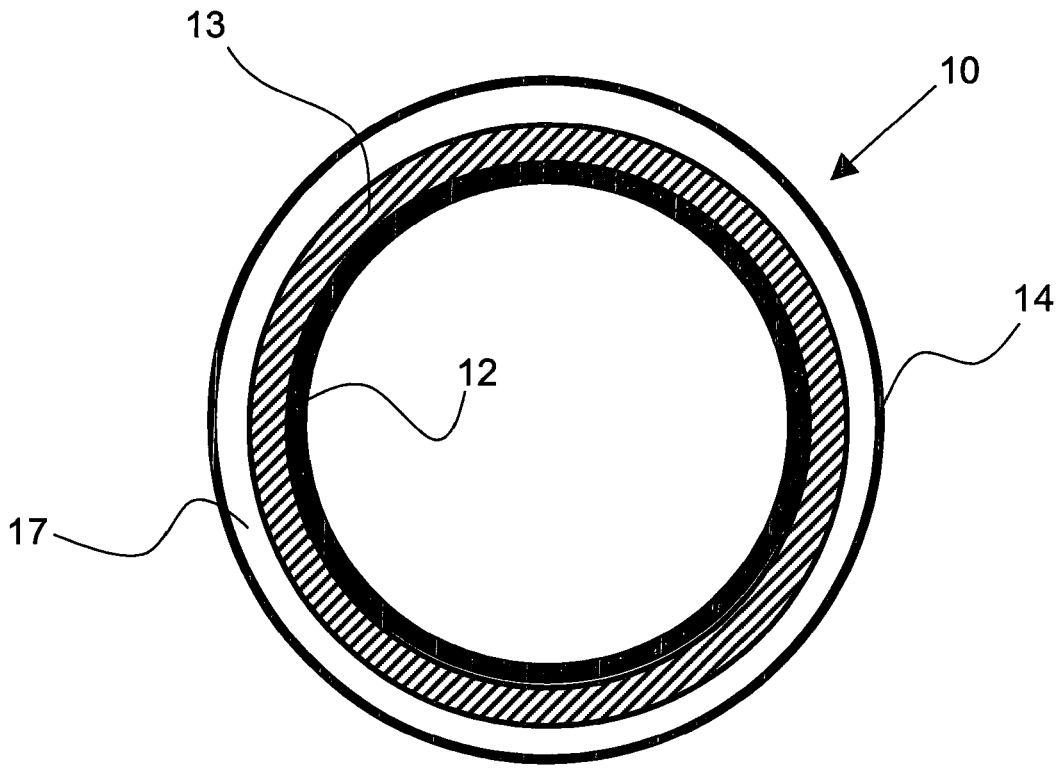
FIG. 4B shows a plan view of the pre-expanded downhole tool shown in FIG. 4A.

FIGS. 4A and 4B show an alternate configuration of an expandable eutectic alloy based downhole tool 10 that can be used in the method of the present invention. Unlike the first configuration of tool 1, which is shown in FIGS. 1, 2A, 2B and 3, the eutectic alloy 13 located on the exterior of the tubular body 12 is not necessarily provided with gaps in it to accommodate the expansion of the tubular body 12.

Instead, the tool 10 shown in FIGS. 4A and 4B is arranged to allow for the fact that the eutectic alloy may fracture when the tubular body 12 expands. To this end the tool is provided with an outer sleeve 14 which, together with the tubular body 12, defines a housing that surrounds the eutectic alloy 13.

Providing the alloy 13 within the housing ensures that the alloy is retained in heating distance of the interior of the tubular body 12 even if the alloy 13 is caused to facture and detach from the tubular body 12 when the tubular body expands. The housing essentially serves to trap any fragments of the alloy that may break off the tubular body during its expansion.

In order to accommodate the expansion of the tubular body and the alloy provided on the exterior thereof, the amount of alloy provided on the tubular body is such that it does not fill the whole of the housing, at least when the tool 10 is in the unexpanded state. Preferably, and as shown in FIGS. 4A and 4B, the outer sleeve 14 is arranged on the tool 10 so as to provide a clearance 17 between the eutectic alloy 13 and the sleeve 14.

It is envisaged that the sleeve 14 also serves to mechanically protect the alloy during the delivery of the tool 10 down a well. Further, the sleeve preferably has insulating properties so as to provide the additional benefits detailed above. In view of this the sleeve is preferably made from fibreglass or a suitable composite plastic material. However, in applications where the sleeve does not need to have insulating properties, the outer sleeve can also be made from steel.

The housing, which serves to retain the alloy 13 in close proximity to the tubular body 12 as it expands, is provided with one or more openings 15 at the lower end of the tool (i.e. the downhole end of the tool). As detailed above, the openings 15 in the sleeve 14 serve to focus the melted alloy so that it can only escape the housing via the openings 15. Alternatively weakened regions capable of revealing openings can be employed to achieve the same effect. The benefits of focusing the alloy in this way are described above.

Also shown in FIG. 4A is anchor ring 16, which is located below the alloy and the sleeve opening 15. As will be appreciated from the following description, when the tubular body 12 is expanded the anchor ring 16 is pushed towards the surrounding well tubing/casing. In this way the anchor ring 16 can be urged against the well tubing/casing and thereby secure the tool 10 within the target region of the well. The anchor ring 16, which is preferably made from steel also, extends radially outwards beyond the alloy 13.

For the sake of clarity the anchor ring 16 has been omitted from FIG. 4B.

Figure 5:
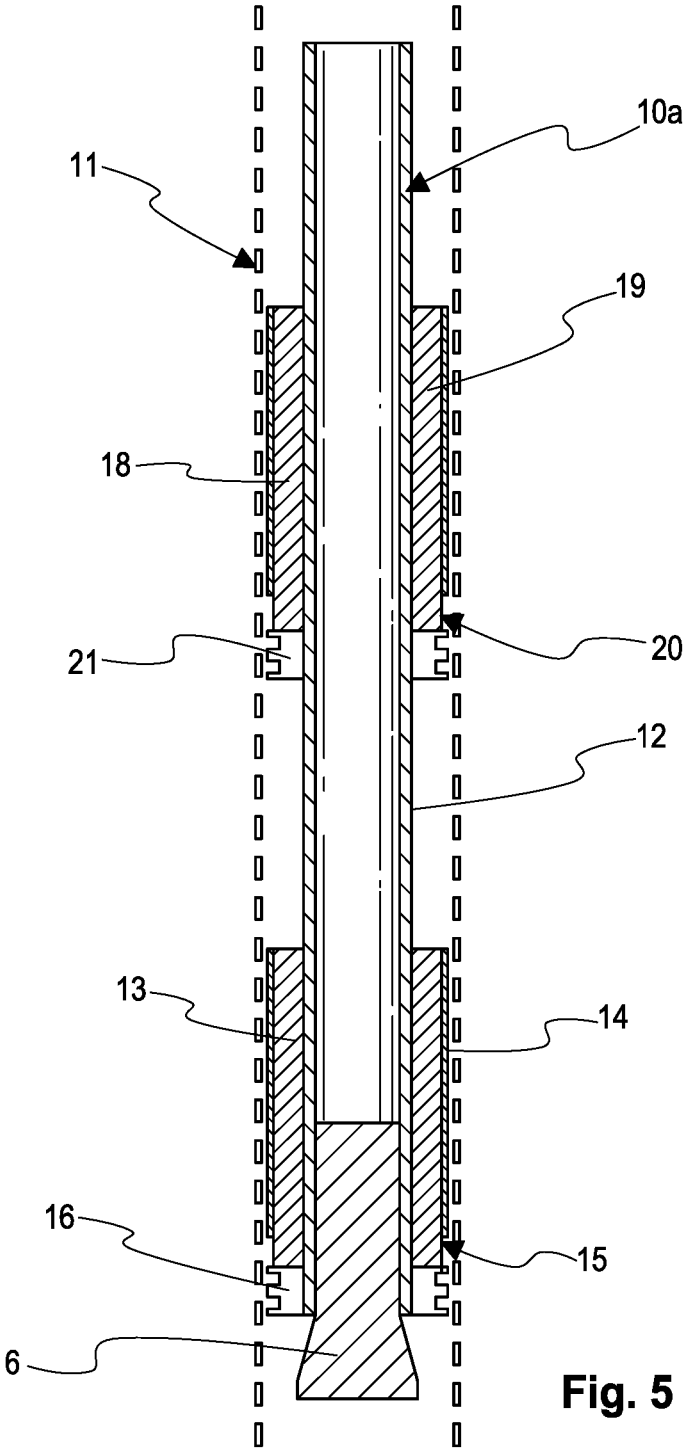
FIG. 5 shows a pre-expanded straddle tool comprising the downhole tool shown in FIG. 4A in situ within an Open Hole Gravel Pack (OHGP)
Figure 6:
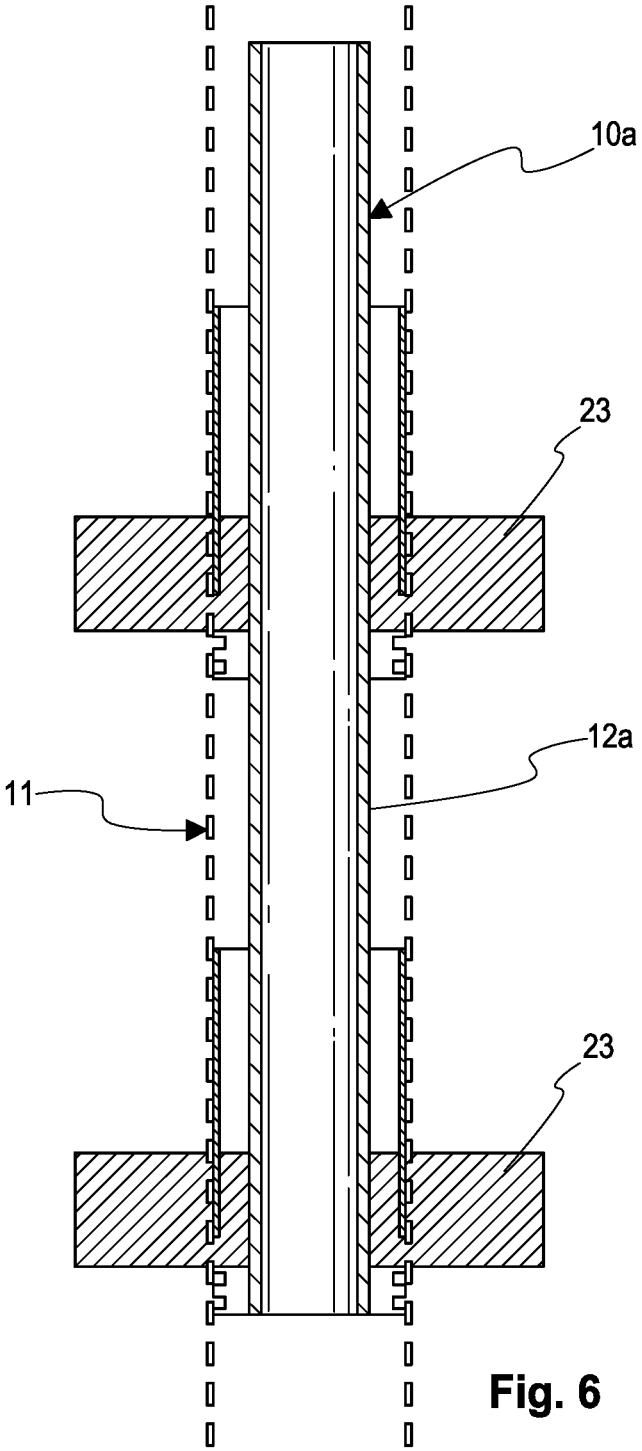
FIG. 6 shows the straddle tool of FIG. 5 once it has been expanded and deployed within the OHGP.
Figure 7:
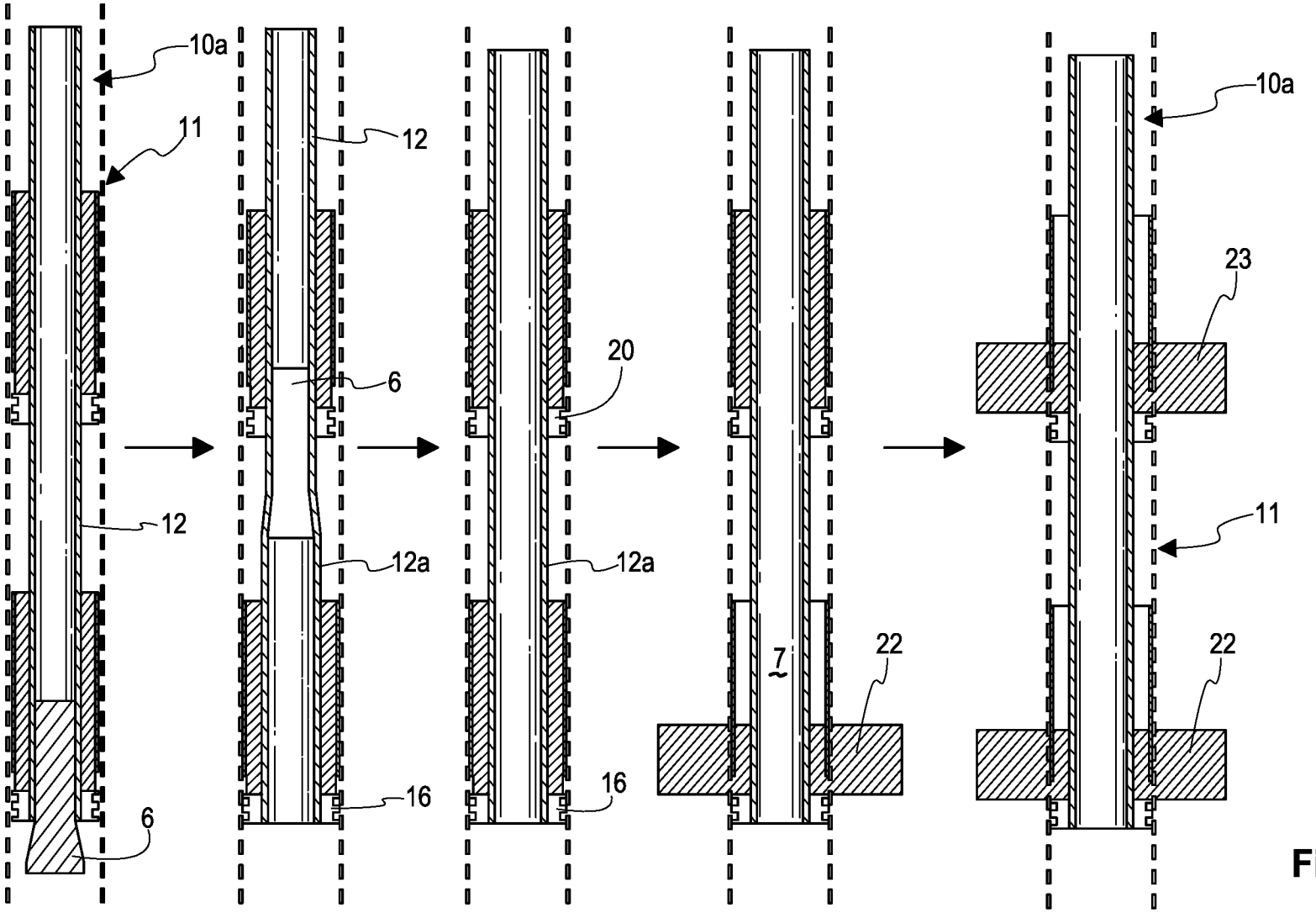
FIG. 7 is a diagrammatic representation of the key stages of deploying the straddle tool shown in FIG. 5.

Turning now to FIGS. 5, 6 and 7, which show a straddle tool 10*a* that essentially comprises two downhole tools 10 of the type shown in FIG. 4A provided on a single common tubular body.

In contrast to the downhole tool deployment process shown in FIG. 3, which shows the deployment of a downhole tool within a standard well tubing/casing, FIGS. 5, 6 and 7 show the deployment of a downhole tool (in this case a straddle) within an Open Hole Gravel Pack (OHGP). As a result the well tubing 5 is replaced with a sandscreen 11 which has a plurality of holes therein to allow oil to flow from the formation into the production tubing during the operation of a well.

FIG. 5 shows the straddle tool 10*a* in situ within a sandscreen 11. It will be appreciated that the outer diameter of the un-expanded straddle tool 10*a* is such that there is a clearance between the tool and the sandscreen 11. This clearance between the tool and the surrounding well structure facilitates easier delivery of the tool down the well.

The straddle tool 10*a* comprises a tubular body 12 made from a suitable material, such as steel, which can be deformed by running an expanding tool through its interior.

A first eutectic alloy element 13 is provided on the exterior of the leading end of the tubular body 12 (i.e. the end of the tubular body that enters the well first). The first alloy element 13 is surrounded by an outer sleeve 14, which, together with the tubular body 12, defines a housing within with the first alloy element 13 is received.

The clearance between the first alloy element 13 and the sleeve, which is shown in FIGS. 4A and 4B, has been omitted from FIGS. 5, 6 and 7 to avoid overcomplicating the figures and making them unclear. Therefore, although no clearance is shown between the first alloy element 13 and the sleeve 14, it will be appreciated that a clearance is present for purposes of the downhole tool 10*a* deployment method represented in FIGS. 5, 6 and 7.

The sleeve 14 is provided with one or more openings 15 located towards the leading end of the first alloy element 13. The opening or openings 15 provide the egress through which the molten alloy can escape the housing when the alloy is melted. The openings can be used interchangeably with the weakened regions described hereinbefore.

Below the first alloy element 13, in the down hole direction, is provided an anchor ring 16. The anchoring ring 16 extends radially outwards beyond the first alloy element 13.

A second alloy element 18 is provided on the tubular body 12 at distance from the first alloy element 13. Preferably the second alloy element 18 is located in the region of trailing end of the tubular body 12 (i.e. the end of the tubular body that enters the well last).

The second alloy element 18 is also provided with an outer sleeve 19. Again, whilst no gap is shown as being present between the alloy element 18 and the sleeve, it will be understood that one is present.

The outer sleeve 19 is provided with at least one opening 20. Again said opening or openings 20 are located at the leading end of the second alloy element 18.

Below the second alloy element 18, in the down hole direction, is provided an anchor ring 21. The anchoring ring 21 extends radially outwards beyond the second alloy element 18.

In addition to the unexpanded straddle tool 10*a* FIG. 5 also shows the tool used to stretch and expand the tubular body 12, which preferably takes the form of a stroker tool 6.

FIG. 6 shows the expanded straddle tool 10*a* secured in position within a well by alloy seals 22, 23 formed at either end of the expanded tubular body 12*a*. The alloy seals 22, 23 which are formed from alloy elements 13 and 18 respectively permeate through the sandscreen 11 so as to securely fix the straddle tool 10*a* in position within the well.

FIG. 7 shows the key stages of the straddle tool deployment, which demonstrate the progress from the start point shown in FIG. 5 to the end point shown in FIG. 6. For the sake of clarity not all features are numbered in FIG. 7. However, it will be appreciated that the features identified in FIGS. 5 and 6 are retained in FIG. 7.

In the first stage shown in FIG. 7 the straddle tool 10*a* is delivered down hole to a target region within an Open Hole Gravel Pack (OHGP) as defined by sandscreen 11, which is effectively a tube with a plurality of holes in it. The reduced diameter of the un-expanded straddle tool 10*a* provides a clearance between the tool and the well that facilitates the easier passage of the tool down a well with obstructions or other restrictions.

Once in position, the stroker tool 6 is actuated to engage the inside of the tubular body 12, preferably using slips, so that the tubular body is held firmly relative to the stroker tool 6. Once the tubular body and the stroker tool 6 are so engaged the wedge portion of the stroker tool is drawn through the interior of the tubular body 12, thereby expanding the leading end of the tubular body 12 upon which the anchoring ring 16 is provided.

The expansion of the leading end of the tubular body 12 causes the anchoring ring 16 to be urged against the surrounding sandscreen 11 so as to anchor the tubular body within the well.

Once the tubular body 12 is anchored within the well by the interaction of the leading anchor ring 16 and the sandscreen 11, the slips are released and the stroker tool 6 is drawn up the rest of the interior of the tubular body 12. This stage is shown in the second step of FIG. 7, wherein the lower part of the tubular body is expanded 12*a* and the upper part of the tubular body has not yet been expanded 12.

The expansion of the tubular body serves to urge the alloy elements 13, 18 closer to the surrounding sandscreen 11 thereby reducing the clearance between them.

It is envisaged that because the eutectic alloy is generally more brittle than the material used to form the tubular body (i.e. steel) the expansion of the tubular body may cause the alloy elements 13 18 to crack and fracture. However because the alloy elements are held within a housing defined by the tubular body and the outer sleeves 14 19, the alloy is maintained in close proximity to the tubular body as it expands. This will be further appreciated from the description of FIGS. 4A and 4B provided above.

As detailed above, the provision of a gap between the alloy and the outer sleeve further facilitates the expansion of the tubular body. It is envisaged that without the gap the stroker tool would need to push against not only the tubular body and the alloy but also the outer sleeve. The provision of a gap between the alloy and the sleeve avoids this additional work.

The expansion of the tubular body also urges the second anchoring ring 20 towards the sandscreen 11.

Once the expansion stage has been completed the alloy elements 13, 18 are located in closer proximity to the sandscreen 11. This is shown in the third step of FIG. 7.

In the fourth step of FIG. 7 a heater 7 is deployed down the well and into the expanded tubular body 12*a*. The heater 7 is positioned with the tubular body 12*a* so as to align with the first alloy element 13 and then the heater is activated. The heat generated by the activated heater 7 passes through the tubular body 12*a* and causes the first alloy element 13 to melt.

The outer sleeve 14, which is preferably made from fibreglass or a suitable plastic composite material having insulating properties, is arranged to prevent the escape of the molten alloy from the tool, other than by way of the opening(s) at the leading end of the tool. In this way the outer sleeve provides a focused outlet for the molten alloy which directs the alloy towards and through the sandscreen 11. It is appreciated in applications where the sleeve does not need to have insulating properties, the sleeve can also be formed from steel.

In addition, the expanded anchor ring 16 provided below the opening(s) 15 helps to reduce the amount of molten alloy lost down the well.

As the molten alloy flows away from the heater it starts to cool and turn back into its solid state. The fluids present in the downhole environment help to promote the cooling of the eutectic alloy within the target region. The first eutectic alloy element eventually cools to form alloy seal 22 which extends from the expanded tubular body 12*a* through the sandscreen 11 and into the surrounding formation.

It will be appreciated that the same process takes place in relation to the second eutectic alloy element 18 provided on the tubular body up hole of the first eutectic alloy element 13. In this way two alloy seals 22, 23 are formed to secure the tubular body in position within the well relative to the sandscreen 11. The final step of FIG. 7 shows the straddle tool 10*a* secured in position by way of the alloy seals 22, 23.

It is envisioned that the two alloy elements may be melted by the same heater tool so as to avoid the need to do multiple runs down hole.

In one arrangement of heater suitable for use in the described method a single heat source could be used to melt both eutectic alloy elements simultaneously. In an alternative arrangement a heater with two separately controllable heat sources could be deployed and activated in turn to melt the first and second eutectic alloy elements.

It is appreciated that although various heat sources could be employed to melt the alloy elements in the method of the present invention, preferably the heater used has a chemical heat source (i.e. thermite based).

It is also appreciated that whilst the above straddle deployment method employs a downhole tool that has a continuous alloy element which encircles the expandable tubular body (i.e. the second configuration of downhole tool of the present invention) the method could also be carried out using a downhole tool with an interrupted ring of eutectic alloy on the exterior of the tubular body (i.e. the first tool configuration).

A further alternative embodiment of the first configuration of the downhole tool 35 of the present invention will now be described with reference to FIGS. 8 and 9.

Figure 9:
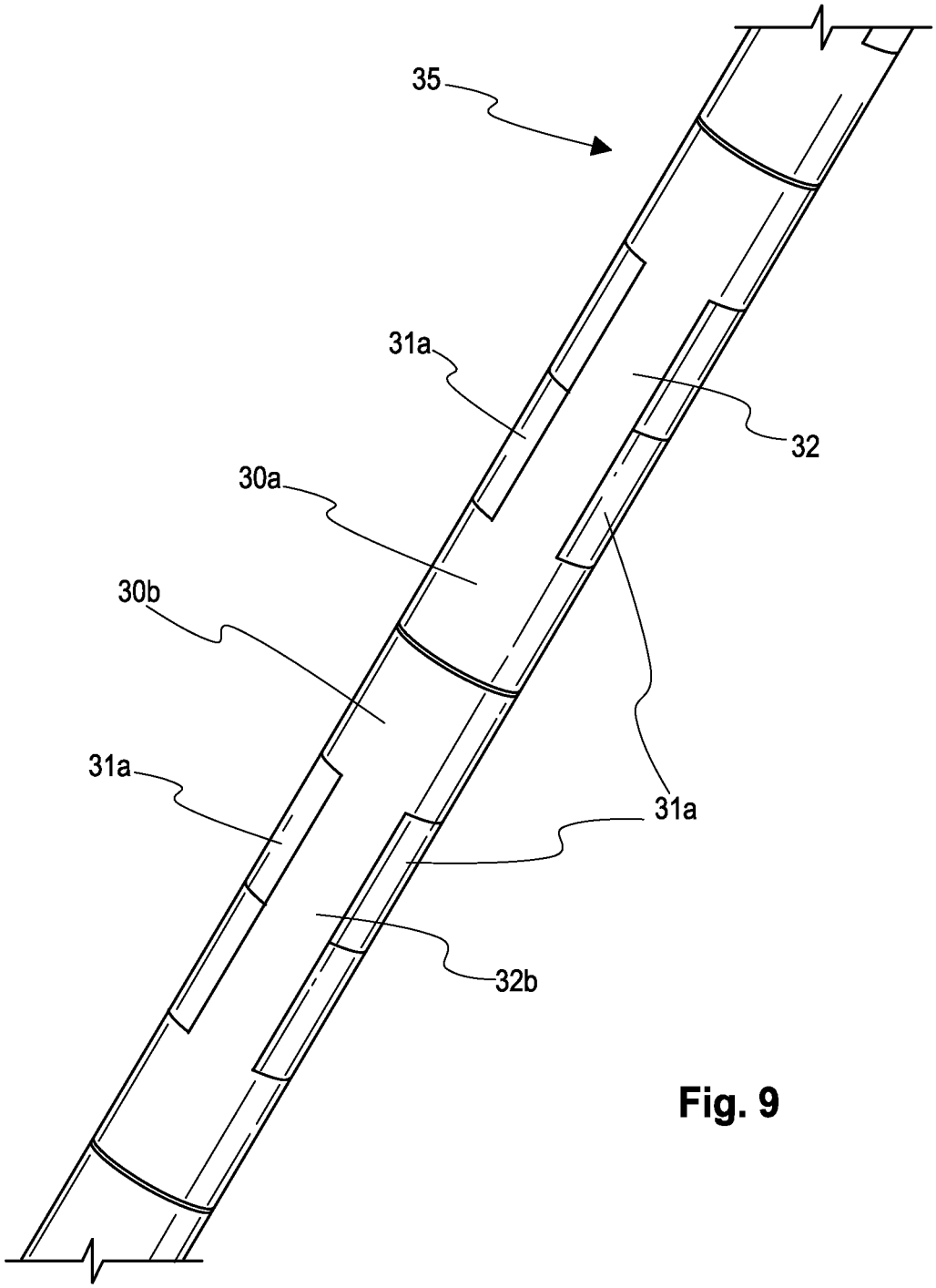
FIG. 9 shows the second embodiment of the first configuration of the pre-expanded expandable eutectic alloy based downhole tool in accordance with the present invention.

The downhole tool 35, which is shown in FIG. 9 without an outer sleeve but may in some variations have the sleeve, shows a tubular body with a plurality of eutectic alloy elements 30, 30*a*, 30*b* provided on its exterior. The tubular body is not visible in FIG. 9 because the interlaced eutectic alloy elements completely cover the tubular body.

Figure 8:
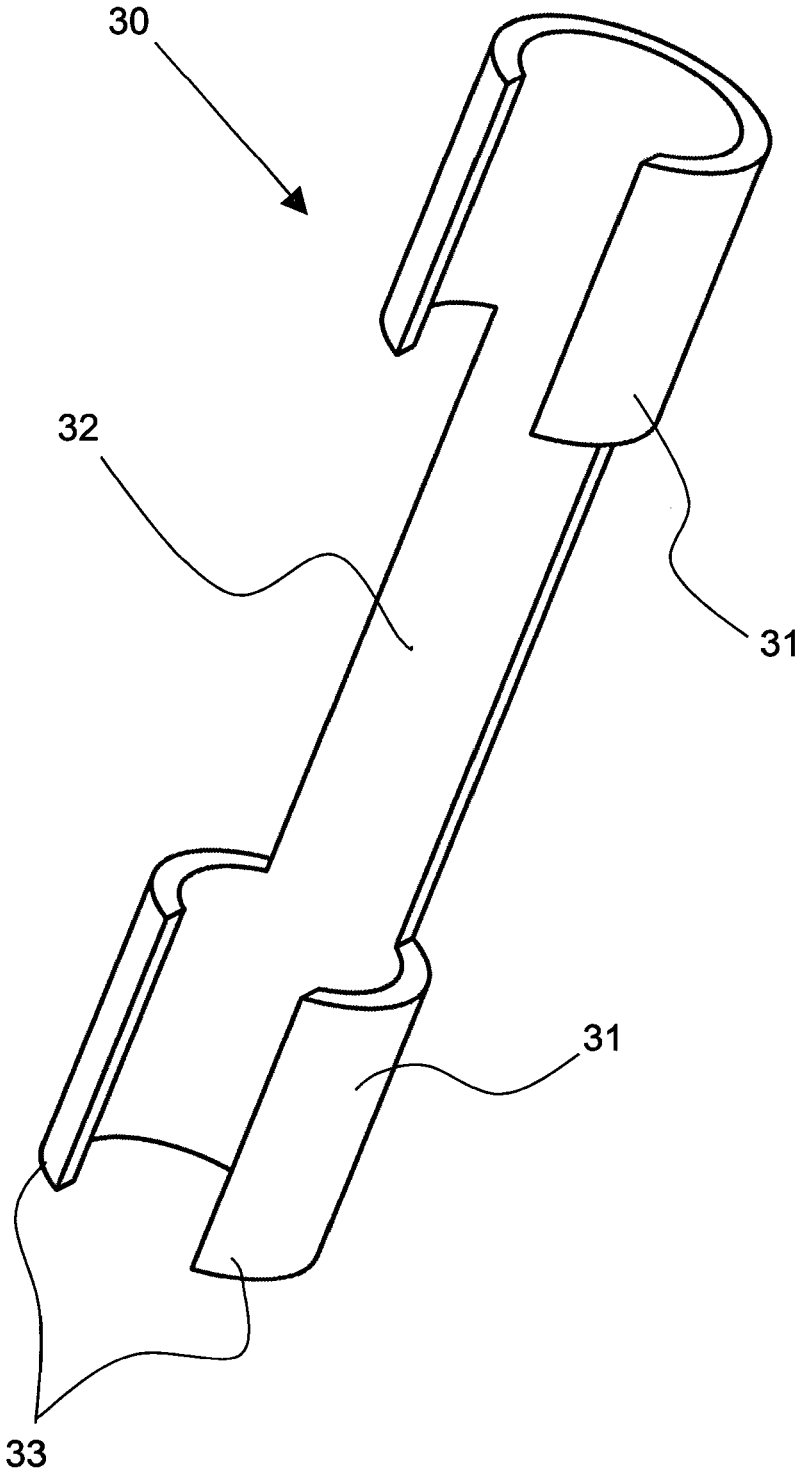
FIG. 8 shows a eutectic alloy element for use in a second embodiment of the first configuration of the pre-expanded expandable eutectic alloy based downhole tool in accordance with the present invention.

The eutectic alloy element 30 will be better appreciated from FIG. 8, which shows a single element. The element 30, which is cast from a suitable eutectic alloy, comprises a clip portion 31 at each end of the element. The clip portions 31 are linked by arm portion 32.

The clip portions 31 have an internal diameter that enables the element to be received on the exterior of an unexpanded tubular body. Each clip portion 31 comprises two spaced apart edges 33.

The distance between the edges 33 is sufficient to accommodate the width of the arm portion 32. In this way it is possible to interlace neighbouring eutectic alloy elements together. The interlacing of adjacent eutectic alloy elements is further facilitated by the fact that the distance between the clip portions on an individual element is sufficient to receive two end clip portions 31.

By interlacing the eutectic alloy elements in the manner shown in FIG. 9 it is possible to encircle a tubular body with alloy whilst providing gaps to accommodate the expansion of the tubular body upon which the alloy elements are located.

It will also be appreciated that interfacing the alloy elements in the manner shown also helps to retain the alloy in position on the tubular body. In addition the alloy can be secured in place using adhesive and/or standard mechanical fixing (e.g. rivets, bolts, screws, etc. . . . ).

It is also appreciated that, rather than casting the shown elements 30 individually, a single cast of alloy could be provided on the tubular body and then cut so as to form the collection of interlaced eutectic alloy elements shown.

Figure 10:
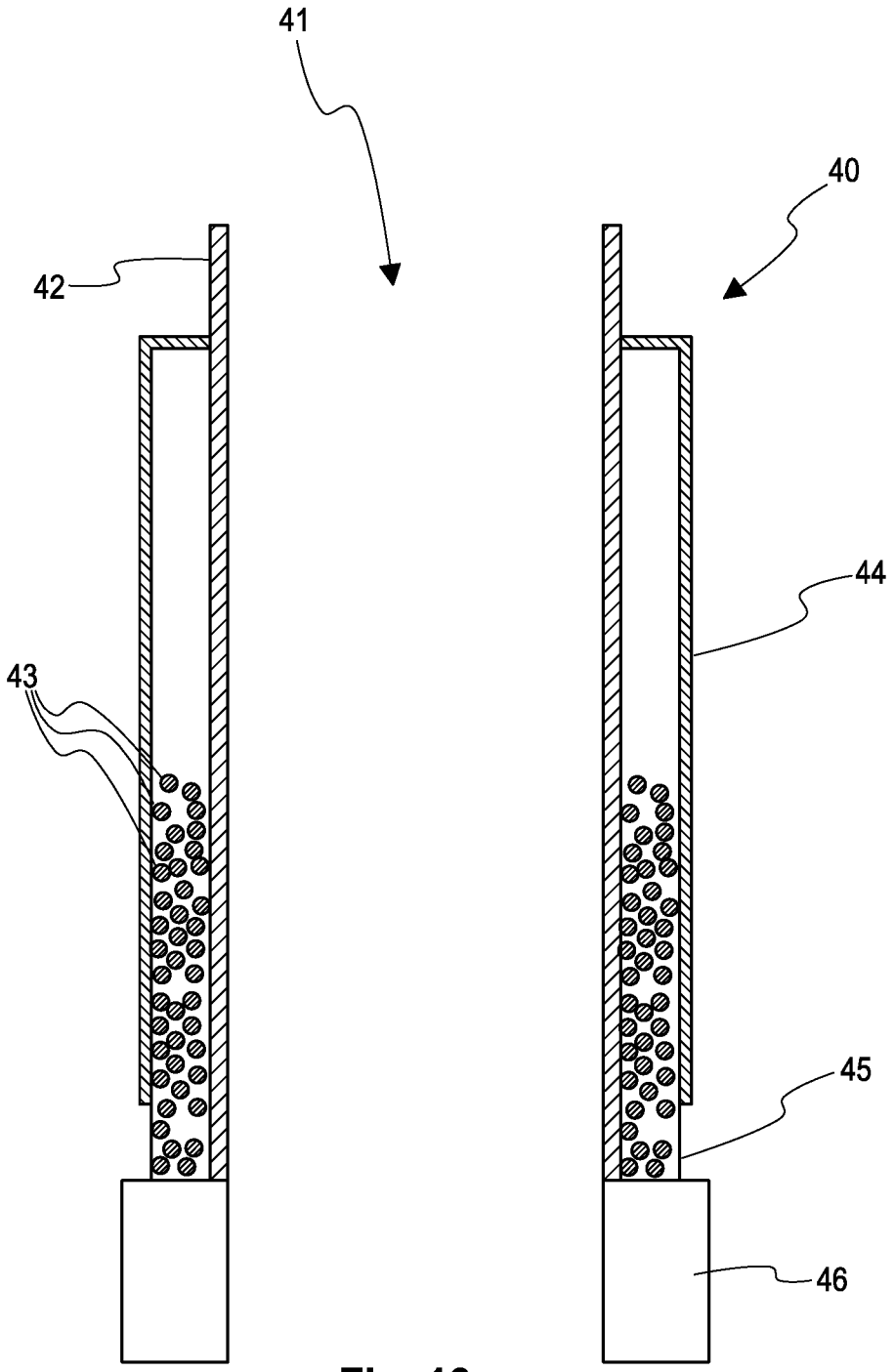
FIG. 10 shows a second embodiment of the second configuration of the pre-expanded expandable eutectic alloy based downhole tool in accordance with the present invention.

A further alternative embodiment of the second configuration of the downhole tool 40 of the present invention will now be described with reference to FIG. 10.

The downhole tool 30 comprises a tubular body 42 with an interior space 41 running through the middle thereof. An outer sleeve 44 is provided that, together with the tubular body 42 defines a housing. Eutectic alloy, which is in the form of a plurality of pellets or shot 43, is retained within the housing.

In contrast to the downhole tool shown in FIG. 4A, the outer sleeve, which is preferably made of steel, fibreglass or a plastic composite material, is not provided with an opening as this would allow the alloy pellets/shot 43 to escape. Instead the sleeve 44 is provided with weakened regions 45 that are configured to fail before the rest of the sleeve. Upon failure the weakened regions 45 reveal an opening akin to that provided from the start in the downhole tool shown in FIG. 4A.

It will be appreciated that the anchor ring 46 co-operates with the tubular body and the sleeve to retain the alloy pellets/shot prior to their melting.

The eutectic alloy pellets/shot does not entirely fill the housing because this provides capacity for the alloy to shift when the tubular body 42 is expanded. It will be understood that the free space at the top of the housing (i.e. where there is no alloy) provides the same function as the gap 17 provided between the eutectic alloy element and the sleeve in the downhole tool shown in FIG. 4A.

It is envisaged that the described embodiments of the downhole tools can be used interchangeably in the methods described hereinbefore. That is to say, the methods shown in FIGS. 3 and 7 could be implemented using any of the above described downhole tools without departing from the general concept of the present invention.

The invention claimed is:

1. A method of deploying a eutectic alloy based tool within a well, said method comprising:

providing a eutectic alloy based downhole tool comprising a tubular body with one or more eutectic alloy elements located on an outer surface thereof, each of the one or more eutectic alloy elements extending only partially around the outer surface of the tubular body, said tool having an outer diameter with a clearance from the inner diameter of the well, said tool further comprising an outer sleeve having insulating properties;

delivering the downhole tool to a target region within an oil/gas well where the tool is to be deployed;

running a tubular expanding tool through the interior of the tubular body so as to increase the outer diameter of the downhole tool and in so doing reduce the clearance between the eutectic alloy and the well;

positioning a heater within the tubular body proximal to the eutectic alloy and operating the heater to melt the eutectic alloy and pass the melted eutectic alloy through a focused outlet in the outer sleeve, the focused outlet provided by openings or weakened regions that form openings when in contact with the melted eutectic alloy; and allowing the eutectic alloy to cool and resolidify so as to seal the tool in place within the target region of the well using the alloy.

2. The method of claim 1, wherein the one or more eutectic alloy elements are located at the end regions of the tubular body.

3. The method of claim 1, wherein at least the one or more eutectic alloy elements are covered with the outer sleeve.

4. The method of claim 3, wherein the sleeve has insulating properties.

5. The methods of claim 3 or 4, wherein said sleeve has opening, or weakened regions that form openings when in contact with the melted alloy, that provide a focused outlet for the melted alloy.

6. The methods of claim 1, 2 or 3, wherein the expanding tool is operated to increase the outer diameter of the entire downhole tool.

7. The methods of claim 1, 2 or 3, wherein the expanding tool is operated selectively so as to only increase the outer diameter of the downhole tool in the parts of the tubular body where the one or more eutectic alloy elements are located.

8. The methods of claim 1, 2 or 3, wherein the one or more eutectic alloy elements are located along the entire length of the tubular body.

9. The method of claim 1, wherein the well comprises an Open Hole Gravel Pack and the method further comprises directing the melted eutectic alloy towards the sandscreen of the Open Hole Gravel Pack.

10. An expandable eutectic alloy based downhole tool, said tool comprising:

an expanding tool;

a tubular body configured to be expanded when said expanding tool is run through the inside thereof;

one or more eutectic alloy elements provided on the outside of the tubular body, wherein each eutectic alloy element only extends partially around the circumference of the outside of the tubular body; and an outer sleeve having insulating properties and a focused outlet for melted eutectic alloy, said focused outlet provided by openings or by weakened regions that form openings when in contact with said melted eutectic alloy.

11. The tool of claim 10, wherein the one or more eutectic elements form an interrupted alloy ring that encircles the tubular body, the ring being formed from one or more alloy elements arranged in series around the circumference of the tubular body.

12. The tool of claim 11, wherein said one or more alloy elements form a plurality of interrupted rings on the outside of the tubular body.

13. The tool of claim 12, wherein the plurality of interrupted rings are offset from one another so that the interruptions in one alloy ring are not aligned with the interruptions in an adjacent ring.

14. The tool of claim 13, wherein two or more interrupted alloy rings are connected together.

15. The tool of claim 11, 12, 13 or 14, wherein said one or more eutectic alloy elements are mounted on an expandable collar that is then secured to the tubular body.

16. The tool of claim 10, 11, or 12, wherein said one or more eutectic alloy elements are provided along the entire length of the tubular body.

17. The tool of claim 10, 11, or 13, wherein the outer sleeve covers at least the region of the tool where said one or more eutectic alloy elements are located.

18. An expandable eutectic alloy based downhole tool, said tool comprising:

an expanding tool;

a tubular body configured to be expanded when the expanding tool is run through the inside thereof;

one or more eutectic alloy elements provided on the outside of the tubular body, wherein each eutectic alloy element only extends partially around the circumference of the outside of the tubular body;

an outer sleeve having insulating properties, wherein the tubular body and the outer sleeve together define a housing with a volume within which the one or more eutectic alloy elements are retained, the outer sleeve having a focused outlet for melted eutectic alloy, said focused outlet provided by openings or by weakened regions that form openings when in contact with said melted eutectic alloy; and wherein the eutectic alloy retained with the housing does not fill the volume of the housing defined by the tubular body and the outer sleeve.

19. The tool of claim 18, wherein the one or more eutectic alloy elements are provided as at least one annular shaped block that encircles the tubular body and there is clearance between the outer surface of said block and the outer sleeve to accommodate the expansion of the tubular body and the block.

20. The tool of claim 18, wherein the one or more eutectic alloy elements are provided as shot or pellets.

* * * * *